US012188113B2

(12) United States Patent
Takahashi et al.

(10) Patent No.: US 12,188,113 B2
(45) Date of Patent: Jan. 7, 2025

(54) AUSTENITIC STAINLESS STEEL AND HYDROGEN RESISTANT MEMBER

(71) Applicant: DAIDO STEEL CO., LTD., Nagoya (JP)

(72) Inventors: Nobuyuki Takahashi, Nagoya (JP); Daisuke Kudo, Nagoya (JP); Tomohiro Ando, Nagoya (JP); Yoshihiko Koyanagi, Nagoya (JP)

(73) Assignee: DAIDO STEEL CO., LTD., Nagoya (JP)

( * ) Notice: Subject to any disclaimer, the term of this patent is extended or adjusted under 35 U.S.C. 154(b) by 0 days.

(21) Appl. No.: 18/105,212

(22) Filed: Feb. 2, 2023

(65) Prior Publication Data

US 2023/0257861 A1 Aug. 17, 2023

(30) Foreign Application Priority Data

Feb. 14, 2022 (JP) ..... 2022-020161
Oct. 26, 2022 (JP) ..... 2022-171286

(51) Int. Cl.

| | |
|---|---|
| ***C22C 38/58*** | (2006.01) |
| ***C22C 38/00*** | (2006.01) |
| ***C22C 38/38*** | (2006.01) |
| ***C22C 38/44*** | (2006.01) |
| ***C22C 38/46*** | (2006.01) |
| ***C22C 38/54*** | (2006.01) |

(52) U.S. Cl.

CPC ..... *C22C 38/58* (2013.01); *C22C 38/001* (2013.01); *C22C 38/002* (2013.01); *C22C 38/44* (2013.01); *C22C 38/46* (2013.01); *C22C 38/54* (2013.01)

(58) Field of Classification Search

CPC ..... C21D 1/26; C21D 6/004; C21D 6/005; C21D 6/02; C21D 7/13; C21D 8/0205; C21D 8/0226; C21D 8/0263; C22C 38/001; C22C 38/002; C22C 38/004; C22C 38/02; C22C 38/06; C22C 38/42; C22C 38/44; C22C 38/46; C22C 38/50; C22C 38/54; C22C 38/58

See application file for complete search history.

(56) References Cited

U.S. PATENT DOCUMENTS

| | | | | |
|---|---|---|---|---|
| 2005/0178477 | A1 | 8/2005 | Igarashi et al. | |
| 2005/0178478 | A1 | 8/2005 | Igarashi et al. | |
| 2005/0194073 | A1 | 9/2005 | Hamano et al. | |
| 2014/0017111 | A1* | 1/2014 | Omura | F16L 9/02 420/44 |
| 2016/0304983 | A1 | 10/2016 | Omura et al. | |
| 2017/0029911 | A1 | 2/2017 | Dan et al. | |
| 2019/0112694 | A1* | 4/2019 | Takagi | C21D 6/004 |

FOREIGN PATENT DOCUMENTS

| | | | |
|---|---|---|---|
| EP | 2692886 | A1 | 2/2014 |
| EP | 3133179 | A1 | 2/2017 |
| EP | 3214194 | A1 | 9/2017 |
| JP | H09-279315 | A | 10/1997 |
| JP | 2017-008413 | A | 1/2017 |
| WO | WO 2004-083477 | A1 | 9/2004 |
| WO | WO 2012-132992 | A1 | 10/2012 |
| WO | WO 2015-159554 | A1 | 10/2015 |
| WO | WO 2017-175739 | A1 | 10/2017 |

OTHER PUBLICATIONS

Extended European Search Report issued Jun. 22, 2023 for European Patent Application No. 23156487.3-1103.

Korean Office Action in KR No. 10-2023-0017840 issued on Oct. 28, 2024 with English translation thereof.

* cited by examiner

*Primary Examiner* — Jenny R Wu

(74) *Attorney, Agent, or Firm* — MCGINN I.P. LAW GROUP, PLLC

(57) ABSTRACT

The present disclosure relates to an austenitic stainless steel contains C≤0.10 mass %, Si≤0.50 mass %, 3.0≤Mn≤8.0 mass %, P≤0.30 mass %, S≤0.30 mass %, 7.0≤Ni≤12.0 mass %, 18.0≤Cr≤28.0 mass %, 1.0≤Mo≤3.0 mass %, 0.03≤V≤0.50 mass %, 0.0003≤B≤0.0300 mass %, 0.0001≤Ca≤0.0300 mass %, 0.35≤N≤0.80 mass %, W≤2.0 mass %, Zr≤0.20 mass %, Cu≤0.5 mass %, Al≤0.10 mass %, and O≤0.050 mass %, with a balance being Fe and unavoidable impurities. The austenitic stainless steel has a number density of coarse alloy carbonitrides of $3\times10^5$ pieces/mm$^2$ or less.

7 Claims, No Drawings

AUSTENITIC STAINLESS STEEL AND HYDROGEN RESISTANT MEMBER

CROSS-REFERENCE TO RELATED APPLICATIONS

This application is based on and claims priority under 35 USC 119 from Japanese Patent Application No. 2022-020161 filed on Feb. 14, 2022 and Japanese Patent Application No. 2022-171286 filed on Oct. 26, 2022, the contents of which are incorporated herein by reference.

TECHNICAL FIELD

The present disclosure relates to an austenitic stainless steel and a hydrogen resistant member, and more particularly to an austenitic stainless steel excellent in strength and hydrogen embrittlement resistance, and a hydrogen resistant member using the austenitic stainless steel.

BACKGROUND ART

In recent years, fuel cell vehicles that use hydrogen as fuel and hydrogen stations that supply hydrogen to fuel cell vehicles have been developed. Since various devices used in the fuel cell vehicle, the hydrogen station or the like (hereinafter collectively referred to as "high-pressure hydrogen gas device") are used in a high-pressure hydrogen gas environment, materials used in these devices are required to have excellent hydrogen embrittlement resistance. A stainless steel (in particular, an austenitic stainless steel with an increased Ni equivalent) has an excellent hydrogen embrittlement resistance and is suitable for this type of application.

Among austenitic stainless steels, SUS316L is known as a material excellent in hydrogen embrittlement resistance. Currently, SUS316L is approved as a stainless steel excellent in hydrogen embrittlement resistance in accordance with standards of compressed hydrogen container for automobiles stipulated in the Japanese High Pressure Gas Safety Act. However, since SUS316L has a low strength, in the case where SUS316L is used in a structural member of a high-pressure hydrogen gas device, the structural member needs to be designed to be thick. As a result, there is a problem that an increased size and increased weight of the device cannot be avoided. In order to reduce the weight of the fuel cell vehicle, to make the hydrogen station compact, and to achieve a high-pressure operation in the hydrogen station, it is preferable that a strength of the stainless steel used for these applications is high.

Therefore, in order to solve this problem, various proposals have been made in the related art.

For example, Patent Literature 1 discloses a stainless steel for high-pressure hydrogen gas, requiring (a) containing predetermined contents of C, Si, Mn, Cr, Ni, V, N, and Al, with a balance being Fe and impurities, and (b) satisfying $2.5Cr+3.4Mn<300N$.

The same document describes that (A) solid-solution strengthening with N is the most effective for improving strength of an austenitic stainless steel, and as the content of N added is increased, the strength is improved, but ductility and toughness are lowered, and (B) when components are adjusted so as to satisfy $2.5Cr+3.4Mn<300N$, tensile strength is improved and elongation is also improved.

Patent Literature 2 discloses an austenitic stainless steel for high-pressure hydrogen gas, requiring (a) containing predetermined contents of C, Si, Mn, Cr, Ni, Al, N, and at least one of V and Nb, with a balance being Fe and impurities, (b) having a tensile strength of 800 MPa or more, (c) having a crystal grain size number of 8 or more, and (d) having a content of an alloy carbonitride having a maximum diameter of 50 nm to 1,000 nm being 0.4 pieces/$\mu m^2$ or more.

The same document describes that (A) when nitrogen is utilized as a solute element, strength of the stainless steel can be improved, but stacking fault energy is decreased, and therefore, durability against hydrogen environment embrittlement is lowered, (B) when V and/or Nb is added to the steel, a fine alloy carbide is precipitated during solid solution heat treatment, and a crystal grain is refined owing to a pinning effect, and (C) when the crystal grain is refined, resistance to hydrogen environment embrittlement of a high nitrogen steel can be improved.

Patent Literature 3 discloses an austenitic stainless steel requiring (a) containing predetermined contents of C, Si, Mn, P, S, Ni, Cr, Mo, N, Nb, and V, with a balance being Fe and impurities, (b) satisfying $15 \leq 12.6C+1.05Mn+Ni+15N$, (c) having a crystal grain size number of less than 8.0, and (d) having a tensile strength of 690 MPa or more.

The same document describes that (A) when the crystal grain size number is 8.0 or less, an excellent machinability can be obtained, (B) C, N, Mn, and Ni are all austenite stabilizing elements, and when contents of these elements are optimized, austenite is stabilized, and even when a crystal grain is coarse, hydrogen embrittlement resistance is improved, and (C) when 1.0% or more of Mo is added, a high tensile strength can be obtained even when the crystal grain size number is less than 8.0.

Further, Patent Literature 4 discloses an austenitic stainless steel material requiring (a) containing predetermined contents of C, Si, Mn, P, S, Ni, Cr, N, Mo, V, and Nb, with a balance being Fe and impurities, (b) having a crystal grain size number of 6.0 or more, (c) having a tensile strength of 800 MPa or more, (d) having a difference between the maximum value and the minimum value of the tensile strength being 50 MPa or less, (e) having the number of alloy carbonitrides each having an equivalent circle diameter exceeding 1,000 nm being 10 pieces/$mm^2$ or more, and (f) having a difference between the maximum value and the minimum value of the crystal grain size number being 1.5 or less.

The same document describes that (A) when the crystal grain size number is 6.0 or more and the difference ($\Delta GS$) between the maximum value and the minimum value of the crystal grain size number is 1.5 or less, the difference between the maximum value and the minimum value of the tensile strength is 50 MPa or less, (B) when a difference between an initial temperature and a final temperature during hot working is 100° C. or less, $\Delta GS$ can be controlled to be 1.5 or less, and (C) when the crystal grain size number is 6.0 or more and the number of alloy carbonitrides exceeding 1,000 nm is 10 pieces/$mm^2$ or more, a tensile strength of 800 MPa or more can be obtained.

In the case where a material having excellent hydrogen embrittlement resistance is used as a structural member of a high-pressure hydrogen gas device, the material is often subjected to processing such as cutting processing, cold working, and welding. Therefore, this type of material is required not only to be excellent in strength and hydrogen embrittlement resistance, but also to be excellent in workability such as cutting machinability, cold workability and weldability.

In addition, in order to reduce a manufacturing cost and a maintenance cost of the high-pressure hydrogen gas device, it is preferable that a material used in the device can be used in an as-solution treated (as-solution heat treated) state or in an as-welded state, and a content of an expensive element such as Ni is small.

In this respect, the stainless steel for high-pressure hydrogen gas described in Patent Literature 1 has a strength of 700 MPa or more after the solution treatment. However, since the stainless steel described in the same document has a large Mn content, an excellent workability may not be obtained.

The austenitic stainless steel for high-pressure hydrogen gas described in Patent Literature 2 achieves crystal grain refinement and high strength by performing a solid solution heat treatment, cold working, and a secondary heat treatment. However, the cold working and the secondary heat treatment cause an increase in manufacturing cost.

Furthermore, the austenitic stainless steel described in Patent Literature 3 is premised on being used in an as-hot-worked state. Therefore, the stainless steel described in the same document has excessive carbonitrides in the steel and has low workability.

Similarly, in Patent Literature 4, by performing a heat treatment at a low temperature (from 930° C. to less than 1,000° C.) after hot working on the austenitic stainless steel, a relatively large amount of relatively coarse alloy carbonitrides are precipitated. Therefore, the stainless steel described in Patent Literature 4 is also considered to have a low workability.

Patent Literature 1: WO2004/083477A
Patent Literature 2: WO2012/132992A
Patent Literature 3: WO2015/159554A
Patent Literature 4: WO2017/175739A

SUMMARY OF THE INVENTION

A problem to be solved by the present disclosure is to provide an austenitic stainless steel having an excellent hydrogen embrittlement resistance, a high strength, and an excellent workability.

In addition, another problem to be solved by the present disclosure is to provide a hydrogen resistant member using such an austenitic stainless steel.

A gist of the present disclosure for solving the above problems is as follows.

[1] An austenitic stainless steel, consisting of:
C≤0.10 mass %,
Si≤0.50 mass %,
3.0≤Mn≤8.0 mass %,
P≤0.30 mass %,
S≤0.30 mass %,
7.0≤Ni≤12.0 mass %,
18.0≤Cr≤28.0 mass %,
1.0≤Mo≤3.0 mass %,
0.03≤V≤0.50 mass %,
0.0003≤B≤0.0300 mass %,
0.0001≤Ca≤0.0300 mass %,
0.35≤N≤0.80 mass %,
W≤2.0 mass %,
Zr≤0.20 mass %,
Cu≤0.5 mass %,
Al≤0.10 mass %, and
O≤0.050 mass %,
with a balance being Fe and unavoidable impurities, and having a number density of coarse alloy carbonitrides of $3\times10^5$ pieces/mm$^2$ or less.

Here, the "coarse alloy carbonitride" refers to an alloy carbonitride having an equivalent circle diameter of more than 1,000 nm.

[2] The austenitic stainless steel according to [1], satisfying:
0.3 mass %≤W≤2.0 mass %, and/or
0.01 mass %≤Zr≤0.20 mass %.

[3] The austenitic stainless steel according to [1] or [2], having
a tensile strength measured at 25° C. being 690 MPa or more.

[4] The austenitic stainless steel according to any one of [1] to [3], having
a crystal grain size number of an austenite crystal grain being less than 8.0.

[5] The austenitic stainless steel according to any one of [1] to [4], having
a reduction of area measured at 25° C. being 30% or more.

[6] A hydrogen resistant member containing the austenitic stainless steel described in any one of [1] to [5].

[7] The hydrogen resistant member according to [6], in which
the austenitic stainless steel includes a portion that is in an as-solution treated state.

[8] The hydrogen resistant member according to [6] or [7], containing a butt-welded portion, in which
the butt-welded portion has a tensile strength as welded, measured at 25° C., being 690 MPa or more.

N is an austenite stabilizing element and a solid-solution strengthening element, but is also an element that lowers stacking fault energy. On the other hand, for example, Si is an element that lowers grain boundary strength, and B is an element that improves the grain boundary strength. Therefore, when a relatively large content of N is added to a steel and at the same time, components are optimized (specifically, the contents of elements that lower the grain boundary strength are limited, and appropriate contents of elements that improve the grain boundary strength are added), an austenitic stainless steel having an excellent hydrogen embrittlement resistance and a high strength can be obtained. In addition, since the content of Ni contained in the steel can be reduced, a raw material cost can be reduced.

Further, the austenitic stainless steel according to the present disclosure exhibits a high strength, for example, even in an as-solution treated state or an as-welded state. In addition, since the content of Mn is relatively small and the number density of coarse alloy carbides is also small, the austenitic stainless steel according to the present disclosure is excellent in workability. Furthermore, when manufacturing conditions are optimized, a crystal grain is moderately coarsened and thus, the workability is further improved.

DESCRIPTION OF EMBODIMENTS

An embodiment of the present disclosure will be described in detail below.

[1. Austenitic Stainless Steel]

[1.1. Main Constituent Elements]

The austenitic stainless steel according to the present disclosure contains the following elements, with a balance being Fe and unavoidable impurities. Types of added elements, content ranges thereof, and reasons for limitation thereof are as follows.

(1) C≤0.10 mass %:

In the present disclosure, C is an impurity. In the case where the content of C is excessive, a large amount of carbides are precipitated, resulting in deterioration of toughness and ductility and corrosion resistance. Therefore, the content of C needs to be 0.10 mass % or less. The content of C is preferably less than 0.05 mass %, and more preferably 0.03 mass % or less.

In the present disclosure, the smaller the content of C, the better. However, an extreme reduction in the content of C causes an increase in manufacturing cost. Considering the manufacturing cost, the content of C is preferably 0.0005 mass % or more. The content of C is more preferably 0.001 mass % or more.

(2) Si≤0.50 mass %:

In the present disclosure, Si is an impurity. Si is combined with Ni and Cr to form an intermetallic compound. Si further promotes growth of intermetallic compounds such as sigma phases. These intermetallic compounds lower a hot workability of steel. Further, in the case where the content of Si is excessive, a grain boundary strength is lowered and a hydrogen embrittlement resistance is lowered. Therefore, the content of Si needs to be 0.50 mass % or less. The content of Si is preferably 0.20 mass % or less, and more preferably 0.09 mass % or less.

In the present disclosure, the smaller the content of Si, the better. However, an extreme reduction in the content of Si causes an increase in manufacturing cost. Considering the manufacturing cost, the content of Si is preferably 0.001 mass % or more. The content of Si is more preferably 0.01 mass % or more.

(3) 3.0≤Mn≤8.0 mass %:

Mn stabilizes austenite and prevents formation of martensite having a high hydrogen embrittlement susceptibility. In addition, Mn improves a solubility of N in molten metal to contribute to improvement of strength. In order to achieve such effects, the content of Mn needs to be 3.0 mass % or more. The content of Mn is preferably 5.1 mass % or more, and more preferably 5.5 mass % or more.

On the other hand, in the case where the content of Mn is excessive, stacking fault energy and the grain boundary strength are lowered, and the hydrogen embrittlement resistance is lowered. Further, in the case where the content of Mn is excessive, the toughness and ductility and the hot workability of the steel are also lowered. Therefore, the content of Mn needs to be 8.0 mass % or less. The content of Mn is preferably 6.9 mass % or less, and more preferably 6.5 mass % or less.

(4) P≤0.30 mass %:

In the present disclosure, P is an impurity. In the case where the content of P is excessive, the hot workability and the toughness and ductility of the steel are lowered. In addition, in the case where the content of P is excessive, a concern about solidification cracking during welding is increased. Therefore, the content of P needs to be 0.30 mass % or less. The content of P is preferably less than 0.10 mass %, and more preferably 0.03 mass % or less.

In the present disclosure, the smaller the content of P, the better. However, an extreme reduction in the content of P causes an increase in manufacturing cost. Considering the manufacturing cost, the content of P is preferably 0.0005 mass % or more. The content of P is more preferably 0.001 mass % or more.

(5) S≤0.30 mass %:

In the present disclosure, S is an impurity. In the case where the content of S is excessive, the toughness and ductility and the hot workability of the steel are lowered. In addition, in the case where the content of S is excessive, a concern about cracking during welding is increased. Therefore, the content of S needs to be 0.30 mass % or less. The content of S is preferably less than 0.10 mass %, and more preferably 0.09 mass % or less.

In the present disclosure, the smaller the content of S, the better. However, an extreme reduction in the content of S causes an increase in manufacturing cost. Considering the manufacturing cost, the content of S is preferably 0.0005 mass % or more. The content of S is more preferably 0.001 mass % or more.

(6) 7.0≤Ni≤12.0 mass %:

Ni stabilizes austenite and increases the stacking fault energy, thereby improving the hydrogen embrittlement resistance. In order to achieve such effects, the content of Ni needs to be 7.0 mass % or more. The content of Ni is preferably 9.0 mass % or more, and more preferably 9.5 mass % or more.

On the other hand, in the case where the content of Ni is excessive, a raw material cost is increased. In addition, in the case where the content of Ni is excessive, the solubility of N in the molten metal is lowered to deteriorate the strength. Therefore, the content of Ni needs to be 12.0 mass % or less. The content of Ni is preferably 10.5 mass % or less, and more preferably 9.9 mass % or less.

(7) 18.0≤Cr≤28.0 mass %:

Cr improves the corrosion resistance of the steel. In addition, Cr improves the solubility of N in the molten metal to contribute to the improvement of the strength. In order to achieve such effects, the content of Cr needs to be 18.0 mass % or more. The content of Cr is preferably 20.0 mass % or more, and more preferably 22.0 mass % or more.

On the other hand, in the case where the content of Cr is excessive, an intermetallic compound or a carbonitride is likely to be excessively precipitated, and the toughness and ductility and the corrosion resistance of the steel are lowered. Therefore, the content of Cr needs to be 28.0 mass % or less. The content of Cr is preferably 26.0 mass % or less, and more preferably 25.0 mass % or less.

(8) 1.0≤Mo≤3.0 mass %:

Mo contributes to the improvement of strength by solid-solution strengthening austenite or forming a carbonitride. In addition, Mo improves the corrosion resistance of the steel. In order to achieve such effects, the content of Mo needs to be 1.0 mass % or more. The content of Mo is preferably 1.5 mass % or more, and more preferably 1.8 mass % or more.

On the other hand, in the case where the content of Mo is excessive, an intermetallic compound or a carbonitride is likely to be excessively precipitated, and the toughness and ductility of the steel are lowered. In addition, in the case where the content of Mo is excessive, the raw material cost is also increased. Therefore, the content of Mo needs to be 3.0 mass % or less. The content of Mo is preferably 2.5 mass % or less, and more preferably 2.2 mass % or less.

(9) 0.03≤V≤0.50 mass %:

V forms a hard alloy carbonitride to improve strength of the steel. In order to achieve such an effect, the content of V needs to be 0.03 mass % or more. The content of V is preferably 0.05 mass % or more, and more preferably 0.08 mass % or more.

On the other hand, in the case where the content of V is excessive, an alloy carbonitride is excessively precipitated, and the toughness and ductility of the steel are lowered. Therefore, the content of V needs to be 0.50 mass % or less. The content of V is preferably 0.30 mass % or less, and more preferably 0.20 mass % or less.

(10) 0.0003≤B≤0.0300 mass %:

B is segregated at a grain boundary to increase a grain boundary fixing force, thereby improving the strength of the steel. In addition, B prevents embrittlement of the steel in a hydrogen environment and improves the hydrogen embrittlement resistance. Further, B improves the hot workability of the steel. In order to achieve such effects, the content of B needs to be 0.0003 mass % or more. The content of B is preferably 0.0005 mass % or more, and more preferably 0.0010 mass % or more.

On the other hand, in the case where the content of B is excessive, a solidification cracking susceptibility of molten metal is improved when welding is performed without using a filler metal. Therefore, the content of B needs to be 0.0300 mass % or less. The content of B is preferably 0.0100 mass % or less, and more preferably 0.0050 mass % or less.

(11) 0.0001≤Ca≤0.0300 mass %:

Ca improves the hot workability of the steel. In order to achieve such an effect, the content of Ca needs to be 0.0001 mass % or more. The content of Ca is preferably 0.0003 mass % or more, and more preferably 0.0005 mass % or more.

On the other hand, in the case where the content of Ca is excessive, Ca and O are combined to lower cleanliness of the steel. As a result, the hot workability is rather lowered, and the toughness and ductility are also lowered. Therefore, the content of Ca needs to be 0.0300 mass % or less. The content of Ca is preferably 0.0150 mass % or less, and more preferably 0.0100 mass % or less.

(12) 0.35≤N≤0.80 mass %:

N stabilizes austenite and improves the hydrogen embrittlement resistance. In addition, N also improves the strength of the steel by solid-solution strengthening and formation of a nitride. Further, N improves the corrosion resistance of the steel. In order to achieve such effects, the content of N needs to be 0.35 mass % or more. The content of N is preferably 0.40 mass % or more, and more preferably 0.46 mass % or more.

On the other hand, in the case where the content of N is excessive, a coarse nitride is generated, and the toughness and ductility of the steel are lowered. In addition, in the case where the content of N is excessive, the hot workability of the steel is lowered, or a blowhole (defect) is likely to be formed during welding. Further, in the case where N is excessive, the stacking fault energy is lowered, and the hydrogen embrittlement resistance is lowered. Therefore, the content of N needs to be 0.80 mass % or less. The content of N is preferably 0.60 mass % or less, and more preferably 0.53 mass % or less.

It should be noted that in a high nitrogen steel, the hydrogen embrittlement resistance may be lowered due to deterioration of the grain boundary strength, whereas in the present disclosure, since the grain boundary strength is improved by optimizing the content of Si, the content of B, and the like, deterioration of the hydrogen embrittlement resistance can be prevented.

[1.2. Auxiliary Constituent Elements]

The austenitic stainless steel according to the present disclosure may further contain one kind or two or more kinds of the following elements in addition to the aforementioned main constituent elements. Types of added elements, content ranges thereof, and reasons for limitation thereof are as follows.

(1) W≤2.0 mass %:

W has an effect of improving corrosion resistance and an effect of improving strength by solid solution or formation of a carbonitride. Therefore, the austenitic stainless steel according to the present disclosure may further contain W. In order to achieve such effects, the content of W is preferably 0.3 mass % or more. The content of W is more preferably 0.8 mass % or more.

On the other hand, in the case where the content of W is excessive, the raw material cost is increased. Therefore, the content of W is preferably 2.0 mass % or less. The content of W is more preferably 1.5 mass % or less.

(2) Zr≤0.20 mass %:

Zr has an effect of forming a crystallized carbide. Since the crystallized carbide serves as a starting point for formation of an inclusion such as MnS and a carbonitride, the size of the inclusion can be reduced and the toughness and ductility can be improved. Therefore, the austenitic stainless steel according to the present disclosure may further contain Zr instead of or in addition to W. In order to achieve such an effect, the content of Zr is preferably 0.01 mass % or more. The content of Zr is more preferably 0.05 mass % or more.

On the other hand, in the case where the content of Zr is excessive, a coarse oxide may be formed and the toughness and ductility may be lowered. Therefore, the content of Zr is preferably 0.20 mass % or less. The content of Zr is more preferably 0.15 mass % or less.

[1.3. Unavoidable Impurities]

The unavoidable impurities mean elements mixed in from ores or scraps used as steel raw materials, or from an environment of a manufacturing process or the like. Specific examples of the unavoidable impurities include the following elements in addition to the aforementioned C, Si, P, and S.

(1) Cu≤0.5 mass %:

In the present disclosure, Cu is an impurity. In the case where the content of Cu is excessive, a concern about solidification cracking during welding is increased. Therefore, the content of Cu is preferably 0.5 mass % or less. The content of Cu is more preferably 0.4 mass % or less.

In the present disclosure, the smaller the content of Cu, the better. However, an extreme reduction in the content of Cu causes an increase in manufacturing cost. Considering the manufacturing cost, the content of Cu is preferably 0.005 mass % or more. The content of Cu is more preferably 0.010 mass % or more.

(2) Al≤0.10 mass %:

In the present disclosure, Al is an impurity. Similar to Si, Al has an effect of deoxidizing the steel. However, in the case where the content of Al is excessive, an excessive nitride is formed and the toughness and ductility of the steel are lowered. In addition, in the case where the content of Al is excessive, a depth of penetration during welding is made shallow. Therefore, the content of Al is preferably 0.10 mass % or less. The content of Al is more preferably 0.05 mass % or less.

In the present disclosure, the smaller the content of Al, the better. However, an extreme reduction in the content of Al causes an increase in manufacturing cost. Considering the manufacturing cost, the content of Al is preferably 0.0005 mass % or more. The content of Al is more preferably 0.001 mass % or more.

(3) O≤0.050 mass %:

In the present disclosure, O is an impurity. O lowers a hot workability of a base material during manufacture. In addition, O lowers the cleanliness of the steel and lowers the toughness and ductility of the steel. Therefore, the content of O is preferably 0.050 mass % or less. The content of O is more preferably 0.030 mass % or less, and further more preferably 0.010 mass % or less.

In the present disclosure, the smaller the content of O, the better. However, an extreme reduction in the content of O causes an increase in manufacturing cost. Considering the manufacturing cost, the content of O is preferably 0.0005 mass % or more. The content of O is more preferably 0.001 mass % or more, and further more preferably 0.002 mass % or more.

[1.4. Properties]

[1.4.1. Number Density of Coarse Alloy Carbonitrides]

The "coarse alloy carbonitride" refers to an alloy carbonitride having an equivalent circle diameter of more than 1,000 nm.

The "number density of the coarse alloy carbonitrides" means the number of coarse alloy carbonitrides per unit area (pieces/$mm^2$). Specifically, the number density is determined by the following method.

That is, a sample of an austenitic stainless steel material is taken so as to include a central portion of a cross section perpendicular to a rolling or forging elongation direction. The above observation region of the sample is mirror-polished. Thereafter, arbitrary 10 fields of view (200 μm×200 μm) in the observation region are observed by using a scanning electron microscope (SEM) including an energy-dispersive X-ray spectrometer (EDS) to identify an alloy carbonitride from a precipitate and an inclusion in each field of view. The alloy carbonitride in the present disclosure is defined as containing either C or N, or both C and N, among the precipitate and the inclusion.

An equivalent circle diameter of the alloy carbonitride specified in each field of view is obtained by image analysis. The equivalent circle diameter means a diameter (nm) when an area of the alloy carbonitride in the field of view is converted into a circle. The number of alloy carbonitrides (coarse alloy carbonitrides) each having an equivalent circle diameter of more than 1,000 nm is counted. An average number of the coarse alloy carbonitrides obtained in the 10 fields of view is defined as the "number density of the coarse alloy carbonitrides (pieces/$mm^2$)" in the present disclosure.

In the case where the coarse alloy carbonitrides are excessively precipitated in a matrix phase, the workability (cuttability) is deteriorated due to abrasive wear of a tool due to the coarse alloy carbonitrides. On the other hand, when a composition of the austenitic stainless steel is optimized and the hot working and/or the solution treatment are performed under appropriate conditions, the number density of the coarse alloy carbonitrides can be reduced. In order to obtain an excellent workability, the number density of the coarse alloy carbonitrides is preferably $3\times10^5$ pieces/$mm^2$ or less. The number density is more preferably $1\times10^4$ pieces/$mm^2$ or less, and further more preferably $1\times10^3$ pieces/$mm^2$ or less.

On the other hand, since even the coarse alloy carbonitrides contribute to the tensile strength, in the case where it is desired to obtain an austenitic stainless steel having a higher strength, the number density is preferably 1 piece/$mm^2$ or more, and more preferably 10 pieces/$mm^2$ or more.

[1.4.2. Tensile Strength]

The "tensile strength" refers to a tensile strength obtained by performing a tensile test by using a No. 14A test piece having a parallel portion diameter of 6 mm in accordance with JIS Z2241:2011.

The austenitic stainless steel according to the present disclosure achieves a tensile strength of 690 MPa or more measured at 25° C., by optimizing hot working conditions and/or solution treatment conditions. When components are further optimized, the tensile strength can be 750 MPa or more, or 800 MPa or more.

[1.4.3. Crystal Grain Size Number]

The "crystal grain size number" refers to a value measured in accordance with JIS G0551 (2005). Specifically, the crystal grain size number is determined by the following method.

That is, a test piece for microscopic observation is taken from an austenitic stainless steel. A microscopic test method for a crystal grain size specified in JIS G0551 (2005) is performed by using the taken test piece to evaluate the crystal grain size number.

More specifically, a surface of the test piece is corroded by using a well-known etchant (glyceregia, Kalling reagent or Marbles Reagent, etc.) to reveal a crystal grain boundary on the surface. In 10 fields of view on the corroded surface, a crystal grain size number of each field of view is obtained. An area of each field of view is approximately 40 $mm^2$. The crystal grain size number of each field of view is evaluated by comparison with the reference chart of crystal grain size defined in 7.1.2 of JIS G0551 (2005). An average crystal grain size number of the fields of view is defined as the crystal grain size number of the austenitic stainless steel according to the present disclosure.

In the austenitic stainless steel according to the present disclosure, since the components are optimized, by optimizing the hot working conditions and/or the solution treatment conditions, the crystal grain size number of an austenite crystal grain can be less than 8.0. In the case where the crystal grain size number is less than 8.0, the crystal grain is moderately increased in size and a cutting resistance is lowered. In addition, chips can be easily separated from a work material and a cutting tool during cutting, and a chip treatability is improved. That is, in the case where the crystal grain size number is less than 8.0, a machinability of the steel is improved. The crystal grain size number is preferably 7.0 or less.

On the other hand, in the case where the crystal grain size number is too small, the crystal grain is excessively increased in size, which may lower the tensile strength of the steel. Therefore, the crystal grain size number is preferably 2.0 or more. The crystal grain size number is more preferably 3.0 or more.

[1.4.4. Reduction of Area]

The "reduction of area" refers to a ratio ($=(S_0-S_u)\times100/S_0$), when a tensile test is performed by using a No. 14A test piece having a parallel portion diameter of 6 mm in accordance with JIS Z2241: 2011, of a difference between an original cross-sectional area ($S_0$) of the tensile test piece before the test and a cross-sectional area ($S_u$) of the tensile test piece after the test with respect to the original cross-sectional area ($S_0$).

The austenitic stainless steel according to the present disclosure can have a reduction of area of 30% or more measured at 25° C., by optimizing the hot working conditions and/or the solution treatment conditions. When the components are further optimized, the reduction of area can be 40% or more, or 50% or more.

Here, in the present disclosure, the "solution treatment" refers to a process of heating a steel material at 800° C. to 1200° C. for 1 minute or longer and cooling the steel material at a cooling rate of water cooling, oil cooling or air cooling, or an equivalent cooling rate thereof.

[1.4.5. Hydrogen Embrittlement Resistance]

A quality of the hydrogen embrittlement resistance can be evaluated based on a magnitude of a relative reduction of area.

Here, the "relative reduction of area" means a value represented by the following equation (1). The larger the value of the relative reduction of area represented by the equation (1), the better the hydrogen embrittlement resistance.

$$\text{Relative reduction of area}=A/B \quad (1)$$

where

A is a reduction of area of a round bar tensile test piece when a low strain rate test was performed under conditions including a test temperature of room temperature and a test atmosphere of hydrogen gas at 87.5 MPa, and B is a reduction of area of a round bar tensile test piece when a low strain rate test was performed under conditions including a test temperature of room temperature and a test atmosphere of helium gas at 87.5 MPa.

It should be noted that in each measurement of A and B, a round bar tensile test piece having a parallel portion diameter of 4 mm was used, and a strain rate was $7\times10^{-5}$/s.

In addition, it is known that the relative reduction of area, which is an index of the hydrogen embrittlement resistance, is inferior in a low strain rate test at a low temperature than in a low strain rate test at room temperature. The austenitic stainless steel according to the present disclosure exhibits an excellent relative reduction of area even in a low strain rate test at a low temperature.

The relative reduction of area in the low strain rate test at a low temperature means a value represented by the following equation (2). The larger the value of the relative reduction of area represented by the equation (2), the better the hydrogen embrittlement resistance.

$$\text{Relative reduction of area}=C/D \quad (2)$$

C is a reduction of area of a round bar tensile test piece when a low strain rate test was performed under conditions including a test temperature of −60° C. and a test atmosphere of hydrogen gas at 87.5 MPa, and D is a reduction of area of a round bar tensile test piece when a low strain rate test was performed under conditions including a test temperature of −60° C. and a test atmosphere of helium gas at 87.5 MPa.

It should be noted that in each measurement of C and D, a round bar tensile test piece having a parallel portion diameter of 4 mm was used, and a strain rate was $7\times10^{-5}$/s.

The austenitic stainless steel according to the present disclosure is excellent in hydrogen embrittlement resistance since the components thereof are optimized. In the austenitic stainless steel according to the present disclosure, in the case where the compositions and structures are further optimized, the relative reduction of area can be 0.8 or more. When the components and/or structures are still further optimized, the relative reduction of area can be 0.9 or more.

[1.5. Applications]

Since the austenitic stainless steel according to the present disclosure is excellent in hydrogen embrittlement resistance, the austenitic stainless steel can be used (a) as an austenitic stainless steel for high-pressure hydrogen gas or (b) as an austenitic stainless steel for a liquid hydrogen environment.

In particular, since the austenitic stainless steel according to the present disclosure is excellent in toughness at an extremely low temperature in addition to the hydrogen embrittlement resistance, the austenitic stainless steel can be used, for example, as materials of (a) a member for a liquid hydrogen pump pressurized hydrogen station and (b) a member used in the liquid hydrogen environment such as a liquid hydrogen valve and a pump member.

[2. Manufacturing Method of Austenitic Stainless Steel]

The austenitic stainless steel according to the present disclosure can be obtained by (a) melting and casting raw materials blended to obtain a predetermined composition, to prepare an ingot, (b) performing a primary hot working on the obtained ingot, (c) performing a secondary hot working on the material obtained by the primary hot working, (c) if necessary, performing a cold working on the material after the secondary hot working, (d) if necessary, performing a solution treatment on the material after the secondary hot working or after the cold working, and (e) if necessary, performing a post-processing on the material after the secondary hot working, after the cold working, or after the solution treatment.

[2.1. Melting and Casting Process]

First, the raw materials blended to obtain the predetermined composition are melted and cast, to prepare an ingot. A method and conditions for melting and casting are not particularly limited, and an optimal method and conditions can be selected according to the purpose. For example, an electric furnace, an argon oxygen decarburization (AOD) furnace, a vacuum oxygen decarburization (VOD) furnace, or the like can be used for the manufacture of molten steel.

It should be noted that, if necessary, the obtained ingot may be subjected to a homogenization heat treatment for removing segregation.

[2.2. Primary Hot Working Process]

Next, a primary hot working is performed on the obtained ingot. The primary hot working is performed to destroy a coarse cast structure and refine the structure, and at the same time, convert the ingot into steel materials such as slabs, blooms and billets. A primary hot working method is not particularly limited, and an optimal method can be selected according to the purpose. Examples of the primary hot working method include hot forging and hot rolling.

It should be noted that the steel materials such as slabs, blooms and billets may be directly manufactured from the manufactured molten steel by a continuous casting method. In this case, the primary hot working process can be omitted.

[2.3. Secondary Hot Working Process]

Next, a secondary hot working is performed on the material obtained in the primary hot working process. The secondary hot working is performed to finish the material obtained in the primary hot working process into a final product shape (for example, a steel plate, a steel bar, a wire rod, and a steel pipe) or a shape close thereto. A secondary hot working method is not particularly limited, and an optimal method can be selected according to the purpose. Examples of the secondary hot working method include hot rolling, hot extrusion, and hot piercing rolling.

Conditions for the secondary hot working are not particularly limited, and optimal conditions can be selected according to the purpose. In addition, the secondary hot working may be performed a plurality of times according to the purpose. A heating temperature of the steel material before the secondary hot working is preferably 900° C. or higher and 1,300° C. or lower.

In addition, in the case where the secondary hot working is performed a plurality of times, a temperature of the steel material at the completion of the secondary hot working performed last is preferably 800° C. or higher and 1,200° C. or lower. This is for optimization of the crystal grain and optimization of the number density of the coarse alloy carbonitrides.

[2.4. Cold Working Process]

Next, if necessary, a cold working may be performed on the material after the secondary hot working. A cold working method is not particularly limited, and an optimal method can be selected according to the purpose. For example, in the case where a material is cold worked into a steel pipe, it is preferable to use a cold drawing method. Alternatively, in the case where a material is processed into a steel plate, it is preferable to use a cold rolling method.

[2.5. Solution Treatment Process]

Next, if necessary, a solution treatment may be performed on the material that is subjected to the secondary hot working or the material that is subjected to the cold working. The solution treatment may be performed only once, or may be performed a plurality of times.

A solution treatment temperature affects properties of a material. In the case where the solution treatment is not performed, or in the case where the solution treatment temperature is too low, the number density of the coarse alloy carbonitrides may be excessively increased and the reduction of area may be lowered. In addition, the crystal grain may be excessively refined, and the cuttability may be lowered. Therefore, the solution treatment temperature is preferably 800° C. or higher. The solution treatment temperature is more preferably 1,000° C. or higher.

On the other hand, in the case where the solution treatment temperature is too high, there is concern that melting occurs locally. Therefore, the solution treatment temperature is preferably 1,200° C. or less.

An optimal holding time at the solution treatment temperature can be selected according to the purpose. In general, the longer the holding time at the solution treatment temperature, the smaller the number density of the coarse alloy carbonitrides. On the other hand, in the case where the holding time is lengthened more than necessary, the crystal grain is excessively coarsened. The optimal holding time varies depending on the solution treatment temperature, but is usually 1 minute to 3 hours. After the holding time is ended, the material is cooled at a cooling rate of water cooling, oil cooling or air cooling, or an equivalent cooling rate thereof.

[2.6. Post-Processing Process]

If necessary, a post-processing may be further performed on the material that is subjected to the secondary hot working, the material that is subjected to the cold working, or the material that is subjected to the solution treatment. Examples of the post-processing include cutting, welding, and cold working. A member thus obtained is used for various applications.

[3. Hydrogen Resistant Member]

The hydrogen resistant member according to the present disclosure contains the austenitic stainless steel according to the present disclosure.

[3.1. Materials]

The austenitic stainless steel according to the present disclosure is excellent in hydrogen embrittlement resistance since the austenitic stainless steel has the predetermined composition. Since other respects regarding the composition of the austenitic stainless steel is as described above, description is omitted.

The austenitic stainless steel constituting the hydrogen resistant member may be in any state of an as-hot-worked state, an as-cold-worked state, an as-solution treated state, or a state after a necessary post-processing after the solution treatment. In order to reduce the number density of the coarse alloy carbonitrides and reduce the manufacturing cost, the austenitic stainless steel constituting the hydrogen resistant member preferably includes a portion that is in the as-solution treated state.

Here, "includes a portion that is in the as-solution treated state" refers to the case where (a) the entire austenitic stainless steel constituting the hydrogen resistant member is in the as-solution treated state, or the case where (b) a part of the austenitic stainless steel constituting the hydrogen resistant member is subjected to necessary post-processing (for example, cutting and welding), whereas the other part thereof is in the as-solution treated state.

[3.2. Shape]

The shape of the hydrogen resistant member is not particularly limited, and an optimal shape can be selected according to the purpose. Examples of the shape of the hydrogen resistant member include a pipe, a rod, a wire, a plate, and the like.

In addition, the hydrogen resistant member may be a member including a welded portion obtained by welding members each having a predetermined shape. A type of a seam of the welded portion (that is, a welded joint) is not particularly limited, and an optimal welded joint can be selected according to the purpose. Examples of the welded joint include a butt joint, a T-joint, a corner joint, a lap joint, and an edge joint.

In the case where the hydrogen resistant member includes the welded portion, a welding method is not particularly limited, and an optimal method can be selected according to the purpose. The welding method may be a welding method using a filler metal, or a welding method using no filler metal. Examples of the filler metal include YS316L, YS309LMo, YS308L, YS308H, YS308N2 and YS308LN.

Examples of the welding method using a filler metal include a TIG welding method, a plasma welding method, a laser welding method, a MIG welding method, a MAG welding method, and a shielded metal arc welding method.

Examples of the welding method using no filler metal include a TIG welding method, a plasma welding method, and a laser welding method.

[3.3. Tensile Strength of Welded Portion]

In the case where the hydrogen resistant member includes the welded portion, the member before welding is preferably subjected to the solution treatment and has a tensile strength of 690 MPa or more measured at 25° C. The tensile strength measured at 25° C. is more preferably 750 MPa or more, and further more preferably 800 MPa or more. In the case where welding is performed by using a high-strength member, a high-strength hydrogen resistant member can be obtained.

In addition, in the case where the composition and structure of the austenitic stainless steel, and the welding method and welding conditions are optimized, a hydrogen resistant member having a high strength even in an as-welded state can be obtained.

For example, when butt welding is performed by using a TIG welding method with or without using a filler metal at a heat input of 0.20 to 0.60 kJ/mm, a hydrogen resistant member including a butt-welded portion can be obtained. At this time, in the case where the composition and structure of the austenitic stainless steel are optimized, a hydrogen resistant member including a butt-welded portion and having a tensile strength of the butt-welded portion as welded, measured at 25° C., being 690 MPa or more can be obtained. In the case where the composition and structure of the austenitic stainless steel are further optimized, the tensile strength of the butt-welded portion as welded, measured at 25° C., can be 750 MPa or more, or 800 MPa or more.

Here, the "tensile strength of the butt-welded portion" refers to a tensile strength when a tensile test is performed by using a No. 1A test piece having a parallel portion width of 12 mm and a plate thickness of 1.5 mm in accordance with JIS Z3121:2013.

[4. Functions]

N is an austenite stabilizing element and a solid-solution strengthening element, but is also an element that lowers stacking fault energy. On the other hand, for example, Si is an element that lowers grain boundary strength, and B is an element that improves the grain boundary strength. Therefore, when a relatively large content of N is added to a steel and at the same time, components are optimized (specifically, the contents of elements that lower the grain boundary strength are limited, and appropriate contents of elements that improve the grain boundary strength are added), an austenitic stainless steel having an excellent hydrogen embrittlement resistance and a high strength can be obtained. In addition, since the content of Ni contained in the steel can be reduced, the raw material cost can be reduced.

Further, the austenitic stainless steel according to the present disclosure exhibits a high strength, for example, even in an as-solution treated state or an as-welded state. In addition, since the content of Mn is relatively small and the number density of coarse alloy carbides is also small, the austenitic stainless steel is excellent in workability. Furthermore, when manufacturing conditions are optimized, a crystal grain is moderately coarsened and thus, the workability is further improved.

EXAMPLES

Examples 1 to 9, Comparative Examples 1 to 8

[1. Preparation of Samples]

In a vacuum induction furnace, 50 kg of steel having a composition shown in Table 1 was melted and cast into an ingot. Then, a hot forging, a hot rolling, a solution treatment, and a machining were performed on the ingot to manufacture a steel bar having a diameter of 30 mm. In Table 1, steels in Examples 5 to 7 have the same composition as the steel in Example 4, and the steel in Comparative Example 8 has the same composition as the steel in Comparative Example 7. It should be noted that in Example 7 and Comparative Example 7, the solution treatment was not performed. In addition, in Comparative Example 8, the solution treatment temperature was 700° C. Except for Example 7 and Comparative Examples 7 and 8, the solution treatment temperature was 900° C. to 1,100° C.

In addition, two steel plates were separately prepared and butt-welded by a TIG welding method without using a filler metal at a heat input of 0.20 to 0.60 kJ/mm.

TABLE 1

| | Components (mass %) | | | | | | | | | | | | | | | |
|---|---|---|---|---|---|---|---|---|---|---|---|---|---|---|---|---|
| Steel Type | C | Si | Mn | P | S | Cu | Ni | Cr | Mo | Al | V | N | B | Ca | O | Others |
| Example 1 | 0.014 | 0.07 | 5.9 | 0.021 | 0.001 | 0.06 | 9.8 | 23.3 | 2.0 | 0.002 | 0.15 | 0.43 | 0.0015 | 0.0025 | 0.005 | |
| Example 2 | 0.010 | 0.08 | 6.1 | 0.015 | 0.001 | 0.05 | 9.5 | 23.0 | 2.0 | 0.005 | 0.13 | 0.46 | 0.0016 | 0.0012 | 0.005 | |
| Example 3 | 0.015 | 0.06 | 5.7 | 0.020 | 0.001 | 0.05 | 9.7 | 23.7 | 1.8 | 0.014 | 0.08 | 0.50 | 0.0011 | 0.0032 | 0.006 | |
| Example 4 | 0.018 | 0.07 | 6.3 | 0.021 | 0.001 | 0.09 | 9.9 | 23.5 | 2.1 | 0.006 | 0.10 | 0.53 | 0.0023 | 0.0041 | 0.005 | |
| Example 5 | 0.018 | 0.07 | 6.3 | 0.021 | 0.001 | 0.09 | 9.9 | 23.5 | 2.1 | 0.006 | 0.10 | 0.53 | 0.0023 | 0.0041 | 0.005 | |
| Example 6 | 0.018 | 0.07 | 6.3 | 0.021 | 0.001 | 0.09 | 9.9 | 23.5 | 2.1 | 0.006 | 0.10 | 0.53 | 0.0023 | 0.0041 | 0.005 | |
| Example 7 | 0.018 | 0.07 | 6.3 | 0.021 | 0.001 | 0.09 | 9.9 | 23.5 | 2.1 | 0.006 | 0.10 | 0.53 | 0.0023 | 0.0041 | 0.005 | |
| Example 8 | 0.025 | 0.09 | 6.5 | 0.031 | 0.002 | 0.11 | 9.8 | 22.5 | 1.9 | 0.009 | 0.16 | 0.47 | 0.0030 | 0.0074 | 0.004 | W: 1.2 |
| Example 9 | 0.012 | 0.05 | 5.6 | 0.025 | 0.001 | 0.11 | 9.6 | 23.9 | 2.0 | 0.036 | 0.18 | 0.51 | 0.0021 | 0.0089 | 0.008 | Zr: 0.065 |
| Comp. Ex. 1 | 0.014 | 0.08 | 6.0 | 0.015 | 0.001 | 0.09 | 12.8 | 23.8 | 2.1 | 0.001 | 0.13 | 0.32 | 0.0021 | 0.0035 | 0.004 | |
| Comp. Ex. 2 | 0.013 | 0.09 | 5.9 | 0.016 | 0.001 | 0.09 | 9.9 | 23.5 | 1.8 | 0.010 | 0.09 | 0.33 | 0.0019 | 0.0022 | 0.005 | |
| Comp. Ex. 3 | 0.005 | 0.55 | 5.8 | 0.015 | 0.002 | 0.04 | 9.8 | 23.1 | 2.1 | 0.004 | 0.09 | 0.48 | 0.0015 | 0.0021 | 0.003 | |
| Comp. Ex. 4 | 0.008 | 0.08 | 5.6 | 0.012 | 0.001 | 0.10 | 9.7 | 22.9 | 1.8 | 0.014 | 0.11 | 0.46 | 0.0001 | 0.0008 | 0.004 | |
| Comp. Ex. 5 | 0.007 | 0.06 | 6.3 | 0.016 | 0.002 | 0.06 | 10.0 | 23.6 | 2.0 | 0.009 | 0.13 | 0.49 | 0.0016 | 0.0032 | 0.003 | Nb: 0.23 |
| Comp. Ex. 6 | 0.011 | 0.09 | 6.2 | 0.015 | 0.001 | 0.07 | 9.9 | 23.9 | 2.0 | 0.011 | 0.12 | 0.50 | 0.0021 | 0.0016 | 0.004 | Ti: 0.31 |
| Comp. Ex. 7 | 0.007 | 0.07 | 6.1 | 0.019 | 0.002 | 0.05 | 10.3 | 23.2 | 2.0 | 0.005 | 0.12 | 0.48 | 0.0017 | 0.0019 | 0.005 | |
| Comp. Ex. 8 | 0.007 | 0.07 | 6.1 | 0.019 | 0.002 | 0.05 | 10.3 | 23.2 | 2.0 | 0.005 | 0.12 | 0.48 | 0.0017 | 0.0019 | 0.005 | |

[2. Test Method]

[2.1. Crystal Grain Size Measurement]

Each steel bar was cut parallel to a rolling direction. A sample for crystal grain size measurement, which used a surface near a center axis of the steel bar among cut surfaces as an observation surface, was taken. Well-known electropolishing was performed on the observation surface of each sample. The crystal grain size number was determined for the observation surface after the electropolishing based on the aforementioned method.

[2.2. Measurement of Number Density of Coarse Alloy Carbonitrides]

The number density of the coarse alloy carbonitrides was measured by the aforementioned method.

[2.3. Reduction of Area and Tensile Strength Evaluation]

A round bar tensile test piece was taken from a central portion of each steel bar. A parallel portion of the round bar tensile test piece was parallel to the rolling direction of the steel bar. A diameter of the parallel portion was 6 mm. A tensile strength TS (MPa) was obtained by performing a tensile test on the round bar tensile test piece at room temperature (25° C.) in the atmosphere.

In addition, a tensile test was also performed on each of butt-welded members. Specifically, a plate-shaped tensile test piece having a welded portion in a center of the parallel portion was prepared from the butt-welded member. A tensile strength TS (MPa) of a butt-welded portion was obtained by performing a tensile test on the plate-shaped tensile test piece at room temperature.

In the tensile test using either the round bar tensile test piece or the plate-shaped tensile test piece, the case where the measured tensile strength TS (MPa) was 690 MPa or more, which is a required strength of a base material, was judged as "A (high strength)", and the case where the measured tensile strength TS (MPa) was less than 690 MPa was judged as "B".

In addition, the reduction of area was calculated based on an area of a fracture surface of the round bar tensile test piece after the tensile test. The case where the reduction of area was 30% or more was judged as "A (high reduction of area)", and the case where the reduction of area was less than 30% was judged as "B".

[2.4. Hydrogen Embrittlement Resistance Evaluation]

A low strain rate test was performed to evaluate a hydrogen compatibility. A test temperature was room temperature or −60° C., and a test atmosphere was helium gas or hydrogen gas at 87.5 MPa. A round bar tensile test piece having a parallel portion diameter of 4 mm was used as a test piece. A strain rate was $7\times10^{-5}$/s.

A reduction of area in the hydrogen gas and a reduction of area in the helium gas were separately calculated based on an area of a fracture surface of the round bar tensile test piece after the low strain rate test. Further, a relative reduction of area at room temperature (=A/B) and a relative reduction of area at −60° C. (=C/D) were calculated based on these reductions of area. In any case, the case having the relative reduction of area of 0.8 or more was judged as "A (excellent in hydrogen embrittlement resistance)", and the case having the relative reduction of area of less than 0.80 was judged as "B".

It should be noted that a high-pressure hydrogen gas environment at −60° C. is an environment in which the reduction of area is most significantly lowered in the austenitic stainless steel.

[2.5. Relative Wear Amount Evaluation]

A bar-shaped test piece was taken from the central portion of each steel bar. A parallel portion of the bar-shaped test piece was parallel to the rolling direction of the steel bar. The bar-shaped test piece has a circular cross section and a diameter of 8 mm.

Peeling processing was performed for 5 minutes on the bar-shaped test piece. A cemented carbide tool with no coating treatment, which corresponds to P20 in the JIS Standard, was used as a tool for the peeling processing. A cutting speed was 100 m/min, a feed was 0.2 mm/rev, and a cut was 1.0 mm. No lubricating oil was used during the peeling processing. The peeling processing was performed under the above conditions, and a flank wear amount $W_1$ (mm) of the cemented carbide tool after the test was measured.

Further, a bar-shaped test piece having a chemical composition corresponding to SUS316 in the JIS Standard (hereinafter referred to as a "reference test piece") was prepared. The shape of the reference test piece was the same as that of the bar-shaped test piece. The peeling processing was performed under the same conditions as above by using the reference test piece, and a flank wear amount $W_0$ (mm) of the cemented carbide tool after the test was measured.

A relative wear amount ratio defined by the following equation (3) was obtained based on the measurement results. The case having the relative wear amount ratio of 0.40 or more was judged as "A (excellent in machinability)", and the having the relative wear amount ratio of less than 0.40 was judged as "B".

$$\text{Relative wear amount ratio} = W_0/W_1 \quad (3)$$

[3. Results]

The results are shown in Table 2. The followings can be found from Table 2. (1) In Comparative Examples 1 and 2, the tensile strength was low. It is considered that this is because the content of N was small. (2) In Comparative Example 3, the hydrogen embrittlement resistance was low. It is considered that this is because the content of Si was excessive. (3) In Comparative Example 4, the hydrogen embrittlement resistance was low. It is considered that this is because the content of B was small.

(4) In Comparative Example 5, the number density of the coarse alloy carbonitrides was high and the cuttability was poor. It is considered that this is because since excessive Nb was contained, the number density of the coarse alloy carbonitrides was increased, and crystal grain refinement was excessively promoted, and because the abrasive wear of the tool was promoted by the coarse alloy carbonitrides. (5) In Comparative Example 6, the number density of the coarse alloy carbonitrides was high and the cuttability was poor. It is considered that this is because since excessive Ti was contained, the number density of the coarse alloy carbonitrides was increased, and crystal grain refinement was excessively promoted, and because the abrasive wear of the tool was promoted by the coarse alloy carbonitrides.

(6) In Comparative Example 7, the number density of the coarse alloy carbonitrides was high and the crystal grain size number was large. Thus, it is considered that the cuttability was poor. It is considered that this is because a temperature at the completion of the final secondary hot working was low. (8) In Comparative Example 8, the number density of the coarse alloy carbonitrides was high and the crystal grain size number was large. Thus, it is considered that the cuttability was poor. It is considered that this is because the solution treatment temperature was low. (9) In each of Examples 1 to 9, the crystal grain size number was less than 8, and the hydrogen embrittlement resistance was excellent. In addition, the tensile strength was 690 MPa or more and the reduction of area was also 30% or more. Further, the relative wear amount ratio was 0.40 or more.

(10) Compared with Examples 5 to 7, Examples 1-4 had a smaller number density of the coarse alloy carbonitrides. It is considered that this is because the hot working conditions and/or the solution treatment conditions were optimized. (11) In Example 8, since W was contained, the tensile strength was improved compared with Examples 1 to 7. (12) In Example 9, since Zr was contained, compared with Examples 1 to 8, the number density of the coarse alloy carbonitrides was increased, thereby improving the reduction of area.

TABLE 2

| | Structure | | Manufacturing Conditions | | Properties | | | | | |
|---|---|---|---|---|---|---|---|---|---|---|
| | | | | | Hydrogen Compatibility (Relative Reduction of Area) | | | | | |
| Steel Type | Crystal Grain Size | Number Density of Coarse Alley Carbonitrides | Temperature at Completion of Final Secondary Hot Working | Solution Temperature | Room Temperature | −60° C. | Tensile Strength | Reduction of Area | Tensile Strength After Welding | Relative Wear Amount |
| Example 1 | #6.2 | 114 | 1,042° C. | 1,050° C. | A | A | A | A | A | A |
| Example 2 | #5.1 | 58 | 1,118° C. | 1,100° C. | A | A | A | A | A | A |
| Example 3 | #6.5 | 102 | 1,098° C. | 1,050° C. | A | A | A | A | A | A |
| Example 4 | #3.8 | 28 | 1,004° C. | 1,100° C. | A | A | A | A | A | A |
| Example 5 | #6.7 | 2,752 | 953° C. | 1,000° C. | A | A | A | A | A | A |
| Example 6 | #6.8 | 6,021 | 1,067° C. | 900° C. | A | A | A | A | A | A |
| Example 7 | #6.8 | 1,585 | 1,052° C. | None (As-Hot-Worked) | A | A | A | A | A | A |

TABLE 2-continued

| | Structure | | Manufacturing Conditions | | Properties | | | | | |
|---|---|---|---|---|---|---|---|---|---|---|
| | | | | | Hydrogen Compatibility (Relative Reduction of Area) | | | | | |
| Steel Type | Crystal Grain Size | Number Density of Coarse Alley Carbonitrides | Temperature at Completion of Final Secondary Hot Working | Solution Temperature | Room Temperature | −60° C. | Tensile Strength | Reduction of Area | Tensile Strength After Welding | Relative Wear Amount |
| Example 8 | #3.2 | 187 | 1,009° C. | 1,100° C. | A | A | A | A | A | A |
| Example 9 | #3.8 | 8,402 | 1,057° C. | 1,040° C. | A | A | A | A | A | A |
| Comp. Ex. 1 | #6.1 | 380 | 1,105° C. | 1,050° C. | A | A | B | A | Not Executed | A |
| Comp. Ex. 2 | #6.5 | 581 | 1,044° C. | 1,000° C. | A | A | B | A | Not Executed | A |
| Comp. Ex. 3 | #6.0 | 437 | 998° C. | 1,050° C. | A | B | A | A | A | A |
| Comp. Ex. 4 | #6.3 | 198 | 954° C. | 1,050° C. | A | B | A | A | A | A |
| Comp. Ex. 5 | #8.2 | 309,856 | 1,026° C. | 950° C. | A | A | A | B | Not Executed | B |
| Comp. Ex. 6 | #8.1 | 312,140 | 1,167° C. | 959° C. | A | A | A | B | Not Executed | B |
| Comp. Ex. 7 | #8.9 | 332,104 | 782° C. | None (As-Hot-Worked) | A | A | A | B | Not Executed | B |
| Comp. Ex. 8 | #8.6 | 351,045 | 994° C. | 700° C. | A | A | A | B | Not Executed | B |

Although the embodiment of the present disclosure has been described in detail above, the present disclosure is not limited to the above embodiment, and various modifications thereof are possible within the scope without departing from the gist of the present disclosure.

INDUSTRIAL APPLICABILITY

The austenitic stainless steel according to the present disclosure can be used as a structural member used in a high-pressure hydrogen gas device.

What is claimed is:

1. An austenitic stainless steel, consisting of:

C≤0.10 mass %,

Si≤0.50 mass %, 3.0≤Mn≤8.0 mass %,

P≤0.30 mass %,

S≤0.30 mass %, 7.0≤Ni≤9.9 mass %, 18.0≤Cr≤28.0 mass %, 1.0≤Mo≤3.0 mass %, 0.03≤V≤0.50 mass %, 0.0003≤B≤0.0300 mass %, 0.0001≤Ca≤0.0300 mass %, 0.35≤N≤0.80 mass %, W≤2.0 mass %, Zr≤0.20 mass %, Cu≤0.5 mass %, Al≤0.10 mass %, and O≤0.050 mass %, with a balance being Fe and unavoidable impurities, and having a number density of coarse alloy carbonitrides of $3\times10^5$ pieces/mm$^2$ or less, having a crystal grain size number of an austenite crystal grain being 6.8 or less, and having a relative wear amount ratio being 0.40 or more, wherein the "coarse alloy carbonitride" refers to an alloy carbonitride having an equivalent circle diameter of more than 1,000 nm, and the relative wear amount ratio is defined by $W_0/W_1$; here $W_0$ events a flank wear amount of a cemented carbide tool with no coating treatment and corresponding to P20 in the JIS Standard when a bar-shaped test piece having a chemical composition corresponding to SUS316 in the JIS Standard is subjected to a peeling processing with the cemented carbide tool under a condition of cutting speed of 100 m/min, a feed of 0.2 mm/rev, a cut of 1.0 mm, and no lubricating oil; and $W_1$ represents a flank wear amount of the same cemented carbide tool when a bar-shaped test piece having the above-described chemical composition is subjected to the same peeling processing with the cemented carbide tool under the same condition.

2. The austenitic stainless steel according to claim 1, satisfying:

0.3 mass %≤W≤2.0 mass %, and/or 0.01 mass %≤Zr≤0.20 mass %.

3. The austenitic stainless steel according to claim 1, having a tensile strength measured at 25° C. being 690 MPa or more.

4. The austenitic stainless steel according to claim 1, having a reduction of area measured at 25° C. being 30% or more.

5. A hydrogen resistant member, comprising the austenitic stainless steel described in claim 1.

6. The hydrogen resistant member according to claim 5, wherein the austenitic stainless steel comprises a portion that is in an as-solution treated state.

7. The hydrogen resistant member according to claim 5, comprising a butt-welded portion, wherein the butt-welded portion has a tensile strength as welded, measured at 25° C., being 690 MPa or more.

* * * * *